US008931522B2

(12) United States Patent
Paige et al.

(10) Patent No.: US 8,931,522 B2
(45) Date of Patent: Jan. 13, 2015

(54) FILL CAP FOR A DRINK CONTAINER

(75) Inventors: Glenn B. Paige, Hickory, NC (US); Gordon E. Atkinson, Hickory, NC (US)

(73) Assignee: Glenn B. Paige, Hickory, NC (US)

( * ) Notice: Subject to any disclaimer, the term of this patent is extended or adjusted under 35 U.S.C. 154(b) by 761 days.

(21) Appl. No.: 13/210,779

(22) Filed: Aug. 16, 2011

(65) Prior Publication Data

US 2013/0042940 A1 Feb. 21, 2013

(51) Int. Cl.
*B67C 3/26* (2006.01)
*A45F 3/16* (2006.01)
*B65D 47/00* (2006.01)

(52) U.S. Cl.
CPC . *A45F 3/16* (2013.01); *B65D 47/00* (2013.01); *B67C 3/26* (2013.01)
USPC ..... 141/2; 141/319; 141/350; 224/414; 220/86.1

(58) Field of Classification Search
CPC ..... B67C 3/26; B65D 47/00; B65D 51/00; B65D 39/00; B65D 51/002; B65D 51/24; B65B 3/04; B01L 3/50825; B62J 9/00; B62J 11/00
USPC ..... 141/2, 313, 319, 329, 330, 335, 346, 141/347, 350, 363–366, 368, 369, 372; 220/86.1, 304, 787; 224/414; 215/247, 215/297
See application file for complete search history.

(56) References Cited

U.S. PATENT DOCUMENTS 2,436,291 A * 2/1948 Daniel ..... 15/257.05
2,957,501 A * 10/1960 Holmes ..... 141/2
D194,794 S 3/1963 Rahr
3,734,149 A * 5/1973 Hansel ..... 141/350
3,903,942 A * 9/1975 Vest ..... 141/301
4,360,119 A 11/1982 Olivo
4,515,752 A * 5/1985 Miramanda ..... 422/568
D281,581 S 12/1985 MacEwen
D281,758 S 12/1985 Trombly
D287,919 S 1/1987 Clements
4,760,933 A * 8/1988 Christner et al. ..... 220/86.2
4,782,982 A * 11/1988 Ellison ..... 222/1
5,202,093 A * 4/1993 Cloyd ..... 422/547
5,244,117 A * 9/1993 Lombardo ..... 222/1
5,297,599 A * 3/1994 Bucheli ..... 141/329
5,431,205 A * 7/1995 Gebhard ..... 141/351
D363,665 S 10/1995 Goto et al.
5,456,294 A * 10/1995 Tsao et al. ..... 141/1
D371,485 S 7/1996 Hickey
5,803,328 A 9/1998 Nakahara
D415,651 S 10/1999 Trombly
5,971,181 A * 10/1999 Niedospial et al. ..... 215/247
D416,436 S 11/1999 Miller
D417,360 S 12/1999 Bickert et al.

(Continued)

*Primary Examiner* — Timothy L Maust
*Assistant Examiner* — Andrew Schmid
(74) *Attorney, Agent, or Firm* — Stevens & Showalter LLP

(57) ABSTRACT

A fill cap for a drink container for receiving an open end of a drink bottle. The fill cap includes a cylindrical collar and an annular flange extending radially inwardly from the cylindrical collar. A valve structure is connected to and surrounded by the annular flange and in includes a pair of generally planar lip members. Each lip member has an outer portion adjoining the inner edge of the flange and the lip members converge at an angle axially downwardly to inner edges where the lip members adjoin each other at a slit. A pair of opposing side walls extend from the flange to edges of the lip members located axially downwardly from the flange. The slit is configured to receive the bottle neck therethrough.

19 Claims, 3 Drawing Sheets

(56) References Cited

U.S. PATENT DOCUMENTS

| | | | | |
|---|---|---|---|---|
| D437,223 | S | 2/2001 | Coy et al. | |
| 6,206,058 | B1 * | 3/2001 | Nagel et al. | 141/302 |
| D458,508 | S | 6/2002 | Thonis et al. | |
| 6,418,987 | B1 * | 7/2002 | Colasacco | 141/384 |
| 6,568,439 | B1 * | 5/2003 | Se et al. | 141/301 |
| 6,578,224 | B1 * | 6/2003 | Lawson et al. | 8/158 |
| D488,376 | S | 4/2004 | Chung | |
| D507,181 | S | 7/2005 | Malik | |
| D525,826 | S | 8/2006 | Kugler | |
| D570,213 | S | 6/2008 | Newman | |
| D589,747 | S | 4/2009 | Wong | |
| D631,348 | S | 1/2011 | Weiss et al. | |
| D647,753 | S | 11/2011 | Lin | |
| D655,160 | S | 3/2012 | Daniel | |
| D666,052 | S | 8/2012 | Trombly | |
| D679,940 | S * | 4/2013 | Paige et al. | D7/392.1 |
| 8,459,312 | B2 * | 6/2013 | Manera et al. | 141/27 |
| 8,540,691 | B2 * | 9/2013 | Hasegawa et al. | 604/411 |
| 2001/0013381 | A1 * | 8/2001 | Nagel et al. | 141/302 |
| 2002/0079286 | A1 * | 6/2002 | Haynes et al. | 215/276 |
| 2002/0162602 | A1 * | 11/2002 | Nagel et al. | 141/302 |
| 2003/0034084 | A1 * | 2/2003 | Nagel et al. | 141/7 |
| 2004/0007287 | A1 * | 1/2004 | Nagel et al. | 141/325 |
| 2004/0261902 | A1 * | 12/2004 | Eddins et al. | 141/326 |
| 2005/0065495 | A1 * | 3/2005 | Zambaux | 604/411 |
| 2005/0263523 | A1 * | 12/2005 | Moss | 220/229 |
| 2006/0163284 | A1 | 7/2006 | Karl et al. | |
| 2007/0131725 | A1 * | 6/2007 | Friedman | 222/518 |
| 2007/0243348 | A1 * | 10/2007 | Yang et al. | 428/34.7 |
| 2007/0277902 | A1 * | 12/2007 | Dieudonat et al. | 141/319 |
| 2008/0054497 | A1 | 3/2008 | Bradley et al. | |
| 2010/0176152 | A1 * | 7/2010 | Johnson | 222/92 |
| 2011/0011908 | A1 * | 1/2011 | Dietterle et al. | 224/414 |
| 2011/0152051 | A1 * | 6/2011 | Murray | 493/213 |
| 2012/0216909 | A1 * | 8/2012 | Levy | 141/2 |
| 2013/0042940 | A1 * | 2/2013 | Paige et al. | 141/2 |
| 2013/0146174 | A1 * | 6/2013 | Zinn et al. | 141/2 |
| 2013/0181015 | A1 * | 7/2013 | Cason | 222/608 |
| 2014/0091121 | A1 * | 4/2014 | Lombard et al. | 224/414 |

* cited by examiner

FILL CAP FOR A DRINK CONTAINER

FIELD OF THE INVENTION

The present invention relates to fluid containers and, more particularly, to a fluid container cap providing a valve for replenishing a fluid in the container.

BACKGROUND OF THE INVENTION

It is a common practice for bicyclists to carry water or other beverages to rehydrate the body, and is particularly desirable for cyclists participating in competition events or long rides. A typical method of hydration for cyclists has been to drink from a water bottle that may be held in a cage on the bicycle, and that may periodically require replacement or refilling during an event. For example, stations along a race route may provide water bottles that the cyclist may mount to the bicycle in place of depleted bottles or that may be used to refill containers supported at one or more location on the bicycle, such as supported to a frame downtube, behind the seat or between the aero bars of the bicycle.

In order to facilitate refilling of containers mounted to the bicycle, various systems have been proposed that permit a cyclist to dispense the contents from a drink bottle into a container, such as by inserting a portion of the drink bottle through a membrane member provided as a lid over the container. For example, a membrane formed of a mesh or sponge material may be located over the opening of the container, and including a passage permitting a cyclist to dispense a drink into the container from a bottle held adjacent to the opening of the container.

SUMMARY OF THE INVENTION

In accordance with an aspect of the invention, an elastomeric fill cap for a drink container is provided. The fill cap is adapted for receiving an open end of a drink bottle having a bottle body with a bottle neck of reduced diameter, the bottle neck having a minor radially extending rib portion defining a thread for receiving a bottle cap and a major radially extending rib portion for engaging an end of the bottle cap located over the minor rib portion. The drink container includes an open end defined by an upper end having an inner perimeter and an outer perimeter. The fill cap comprises a cylindrical collar having an axial lower end and an axial upper end. An annular flange extends radially inwardly from the cylindrical collar, the annular flange having a radial outer edge connected to the axial upper end of the cylindrical collar and a radial inner edge. A valve structure is connected to and surrounded by the annular flange. The valve structure comprises a pair of generally planar lip members. Each lip member has an outer portion adjoining the inner edge of the flange and the lip members converge at an angle axially downwardly to inner edges where the lip members adjoin each other at a slit. A pair of opposing side walls extend from the inner edge of the flange to edges of the lip members located axially downwardly from the inner edge of the flange. The slit is configured to receive the bottle neck therethrough.

In accordance with another aspect of the invention, a fill cap is provided in combination with a drink container. The fill cap is formed of an elastomeric material and configured for receiving an open end of a drink bottle having a bottle body with a bottle neck of reduced diameter. The drink container includes an open end defined by an upper end having an inner perimeter and an outer perimeter. The fill cap comprises a cylindrical collar having an axial lower end and an axial upper end. An annular flange extends radially inwardly from the cylindrical collar. The annular flange has a radial outer edge connected to the axial upper end of the cylindrical collar and a radial inner edge. A valve structure is connected to and surrounded by the annular flange. The valve structure comprises a pair of generally planar lip members. Each lip member has an outer portion adjoining the inner edge of the flange and the lip members converging at an angle axially downwardly to inner edges where the lip members adjoin each other at a slit. A pair of opposing side walls extend from the inner edge of the flange to edges of the lip members located axially downwardly from the inner edge of the flange. An inner diameter of the collar, in an unstretched condition, is smaller than a diameter of the outer perimeter of the drink container, and the lip members are coupled to the collar via the annular flange to effect a predetermined opening of the slit when the collar is positioned over the upper end of the drink container.

In accordance with a further aspect of the invention, a method of using a fill cap to fill a drink container from a drink bottle is provided. The drink bottle has a bottle body with a bottle neck of reduced diameter. The bottle neck has a minor radially extending rib portion defining a thread for receiving a bottle cap and a major radially extending rib portion for engaging an end of the bottle cap located over the minor rib portion. The fill cap comprises a cylindrical collar positioned over an open upper end of the drink container, and an annular flange having a radial outer edge connected to the cylindrical collar and a radial inner edge. A valve structure is connected to and is surrounded by the annular flange. The valve structure comprises a pair of generally planar lip members, each lip member having an outer portion adjoining the inner edge of the flange. The lip members converge at an angle axially downwardly to inner edges where the lip members adjoin each other at a slit. A pair of opposing side walls extend from the inner edge of the flange to edges of the lip members located axially downwardly from the inner edge of the flange to define a cup area above the lip members and at least partially surrounded by the side walls. The method comprises: inserting the drink bottle into the cup area with at least the portion of the bottle neck including the minor rib portion positioned extending through the slit; providing a flow of fluid transferring the fluid from the drink bottle into the drink container; and providing a flow of air through predetermined openings formed between the lip members and the bottle neck at opposing ends of the slit when the bottle neck is positioned through the slit to effect a release of air pressure from the drink container as the fluid is transferred from the drink bottle to the drink container.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
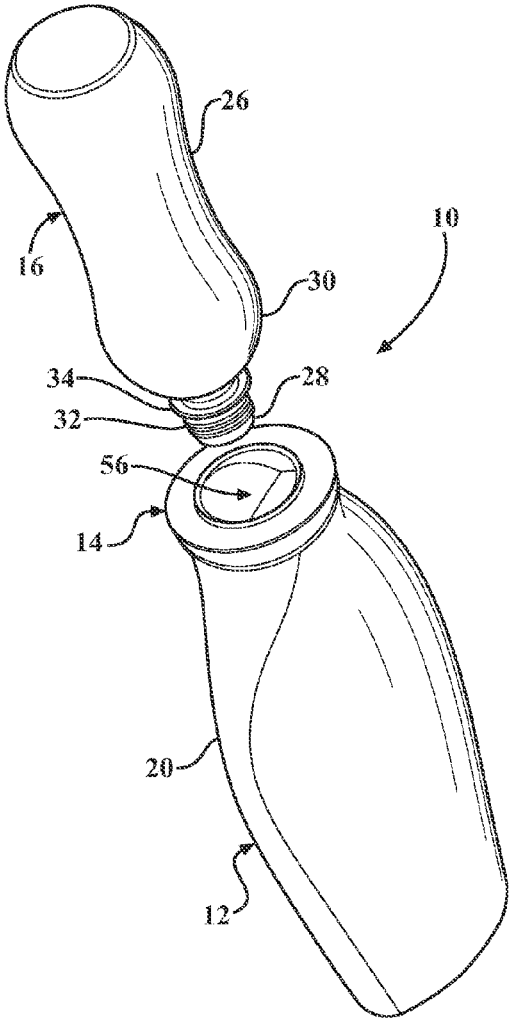
FIG. 1 is a perspective view of a hydration system in accordance with an aspect of the present invention.

Referring to FIG. 1, the present invention provides a hydration system 10 including a drink container 12, a fill cap 14, and a drink bottle 16. The fill cap 14 is shown supported on an open end of the drink container 12 defined by an upper end 18 thereof. Generally, the drink container 12 may be a container, vessel or bottle that may be used for hydrating a user during an athletic event such as, for example, may be mounted to a bicycle for hydrating a cyclist. As such, the drink container 12 may be of a conventional or known configuration including, for example, an aerodynamic body 20 and a generally circular inner perimeter 22 and outer perimeter 24 (see FIG. 6) defining the open end at the upper end 18 of the drink container 12. In addition, the drink container 12 may include a drink tube or straw (not shown) that may extend from the container 12 to a user for hydrating the user from the contents of the container 12 in a known manner.

It should be noted that the present description uses terms such as "upper", "lower", "upwardly", "downwardly", "inner" and "outer", or similar terms, to describe elements of the invention relative to each other are used for purposes of illustration with reference to an embodiment and usage of the invention. However, these terms are not intended to imply a limitation with reference to particular orientations in which the structure of the invention may be used.

Referring to FIG. 1, the drink bottle 16 in accordance with an aspect of the invention comprises a design such as is typically associated with bottles containing approximately 16 fluid ounces of water, and which are commonly provided to cyclists at stations along an event route. In particular, the drink bottle 16 includes a bottle body 26, a bottle neck 28, and a shoulder portion 30 configured as a tapered surface forming a transition from a relatively narrow dimension of the bottle neck 28, i.e., a diameter of about 1 inch, to a relatively broad dimension of the bottle body 26, i.e., a diameter of about 2.5 inches. It may be appreciated that although particular reference is made to "water" bottles, the drink bottle 16 in accordance with the present invention may comprise other drinks for hydrating a user, and which are generally provided in a configuration similar to that described herein for the drink bottle 16.

Figure 6:
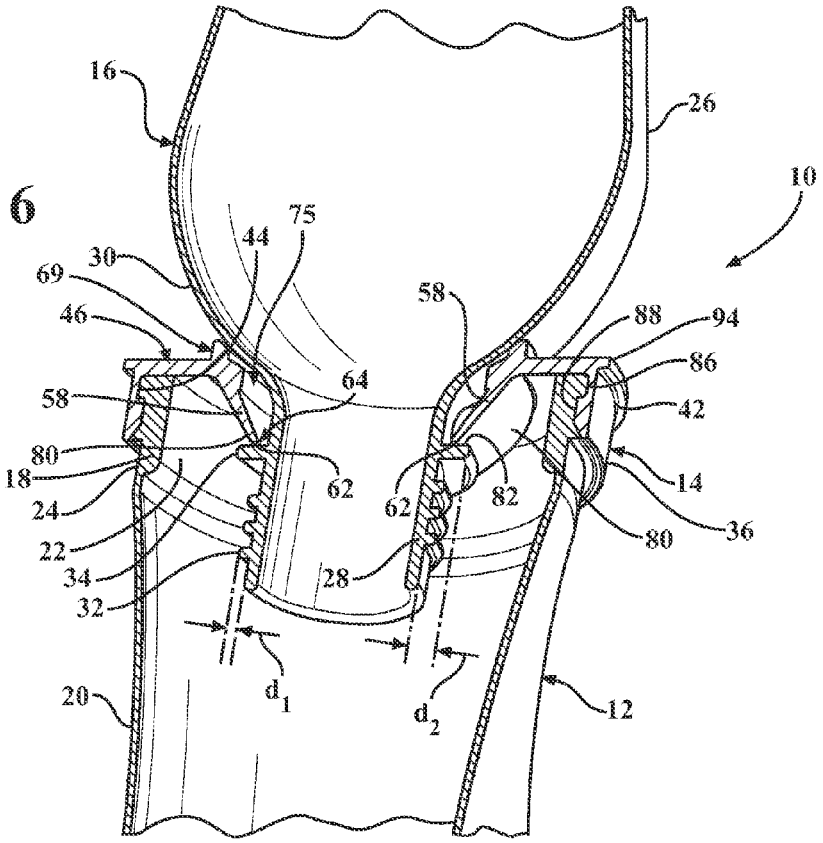
FIG. 6 is cross-sectional perspective view illustrating a drink bottle located in a supported position extending within the fill cap.

As may be seen in FIG. 6, the bottle neck 28 further may include a minor radially extending rib portion 32 extending radially outwardly from the bottle neck 28 a first radial distance $d_1$ outwardly from the surface of the bottle neck 28, and a major radially extending rib portion 34 extending radially outwardly from the surface of the bottle neck 28 a second radial distance $d_2$. The first radial distance $d_1$ is smaller than the second radial distance $d_2$, and the minor rib portion 32 is configured to form a thread for threadably receiving a bottle cap (not shown). The major rib portion 34 is positioned on the bottle neck 28 to engage an end of the bottle cap (not shown) located in engagement over the minor rib portion 32, such as to form a stop for the threaded engagement of the bottle cap. It should be understood that structure of the minor and major rib portions 32, 34 are of the type conventionally provided on drink bottles, and that the major rib portion 34 may be positioned at a location adjacent to the minor rib portion 32 for engagement with bottle caps commonly found on drink bottles, such as bottle caps including a frangible tamper seal ring (not shown).

In accordance with an aspect of the invention, the fill cap 14 is provided as an interface member between the drink container 12 and the drink bottle 16 in order to facilitate use of the drink bottle 16 and its contents to replenish a fluid supply stored in the drink container 12. As is described in greater detail below, the fill cap 14 forms a closure structure for retaining fluid in the drink container 12, and for releasably receiving and retaining the drink bottle 16 during refilling of the drink container 12.

Figure 4:
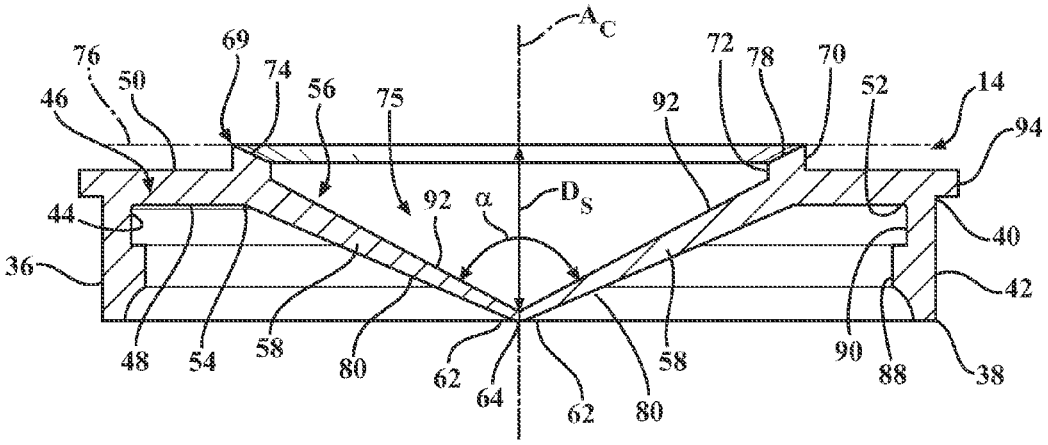
FIG. 4 is a cross-sectional view through the fill cap, taken along line 4-4 in FIG. 2.
Figure 2:
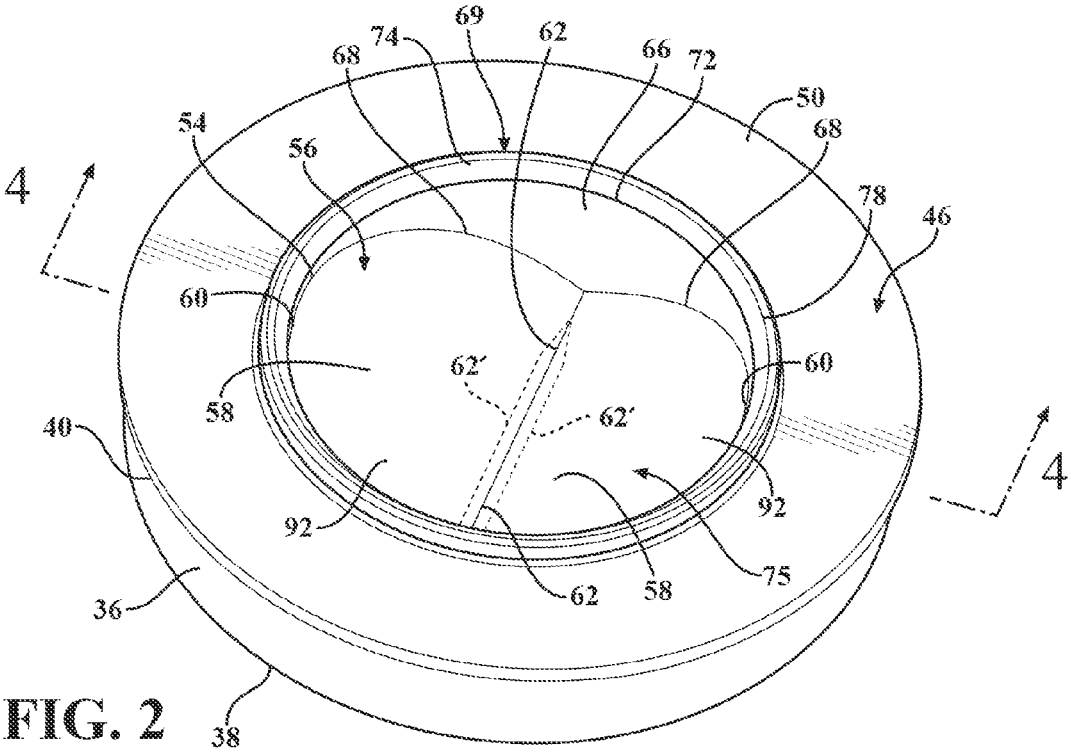
FIG. 2 is a top perspective view of a fill cap for the hydration system.
Figure 3:
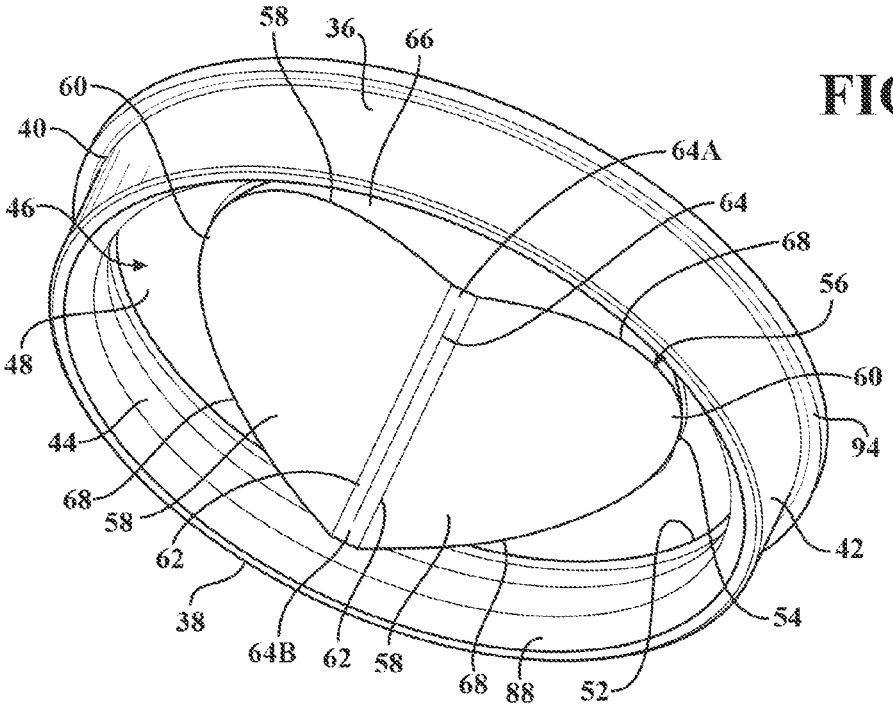
FIG. 3 is bottom perspective view of the fill cap for the hydration system.

Referring to FIGS. 2-4, the fill cap 14 comprises a unitary elastomeric structure including a cylindrical collar 36 having an axial lower end 38 and an axial upper end 40. The collar 36 includes an outwardly facing surface 42 and an inwardly facing surface 44 for engaging the outer periphery 24 of the drink container 12, and further defines a central longitudinal axis $A_c$ (FIG. 4) of the fill cap 14. An annular flange 46 extends radially inwardly from the cylindrical collar 36. The annular flange 46 comprises a generally planar member including a lower surface 48 configured to face inwardly toward an interior of the drink container 12 and an upper surface 50 defining a plane 76 perpendicular to the central longitudinal axis $A_c$. The annular flange 46 further comprises a radially outer edge 52 connected to the axial upper end 40 of the collar 36 at the lower surface 48 of the flange 46, and includes a radially inner edge 54 (FIGS. 3 and 4).

As seen in FIGS. 2-4, a valve structure 56 is connected to and surrounded by the annular flange 46 such that the valve structure 56 is supported centrally in the fill cap 14. The valve structure 56 includes a pair of generally planar lip members 58. The lip members 58 each include a radially and axially outer portion 60 that adjoins and is connected to the inner edge 54 of the flange 46. The lip members 58 converge at an angle axially downwardly, i.e., in the axial direction of the axial lower end 38, to inner lip edges 62 where the lip members 58 adjoin each other at a slit 64. As is discussed further below, when the fill cap 14 is not mounted to the drink container 12, the fill cap 14 is in a generally unstretched condition, and the inner lip edges 62 of the lip members 58 may be in engagement with each other to define a normally closed slit 64, i.e., a slit 64 wherein the lip edges 62 are substantially touching or closely adjacent to each other. It should be noted that the present design for the valve structure 56 is not configured to, and need not comprise structure to, provide a predetermined closing biasing force, such as for providing a force at the lip edges 62 to maintain the slit 64 in a normally closed position.

The valve structure 56 further includes a pair of opposing side walls 66 extending axially downwardly from the inner edge 54 of the annular flange 46 and joined to outer edges 68 of the lip members 58 that are located axially downwardly from the lower surface 48 of the flange 46. The side walls 66 locate and provide support to the lip members 58, substantially maintaining the slit 64 formed by the lip members 58 in a position comprising a generally closed state when the fill cap 14 is in an unstretched condition. The slit 64 has a length that is less than an inner diameter defined by the side walls 66. Hence, diametrically opposing sections of the junction between the lip members 58 comprise solid or unslit end portions 64*a*, 64*b* (FIGS. 3 and 5), providing strength against tearing and propagation of the slit 64 into the side walls 66 during use and for facilitating biasing of the slit 64 to the closed position.

As seen in FIG. 4, an annular ridge 69 extends upwardly from the plane 76 defined by the upper surface 50 of the flange 46. The annular ridge 69 is defined by an axially extending outer surface 70 and an axially extending inner surface 72. At least a portion of the inner surface 72 may be contiguous with the side walls 66. An area above the lip members 58, surrounded by the side walls 66 and the annular ridge 69, defines a cup area 75 of the fill cap 14 for receiving a portion of the drink bottle 16 including the bottle neck 28 and the shoulder portion 30. Further, an outer end portion 74 of the annular ridge 69, distal from the flange 46, is tapered extending radially outwardly extending in a direction away from the flange 46. The taper of the outer end portion 74 is configured to engage the shoulder portion 30 of the drink bottle 16 when the drink bottle 16 is positioned within the cup area 75 in engagement with the fill cap 14, as will be further described below.

In accordance with an aspect of the invention, the above described elements of the fill cap 14 are preferably formed as a unitary molded structure. Further, the fill cap 14 may be formed of a molded thermoplastic material, such as SANTOPRENE®, or a similar thermoplastic material. In addition, the material of the fill cap 14 preferably has a material hardness in the range of about 60-80 Durometer Shore A in order to provide a material stiffness capable of holding the drink bottle 16 in engagement with the fill cap 14 during a use of the hydration system 10, as is described further below.

As described above, the lip members 58 are oriented in converging relation to each other. In particular, the lip members 58 are configured with an angle that places the slit 64 at a predetermined location or distance $D_s$ from a plane 76 defined at an outermost location 78 on the outer end portion 74 of the annular ridge 69, as seen in FIG. 4. An included angle a between the lip members 58 may be within a range of from 130 degrees to 135 degrees. More particularly, the included angle αbetween the lip members 58 may be about 133.5 degrees. The described angular relationship of the lip members 58, and their vertical or axial location within the fill cap 14, is such that a ratio of a diameter of the inner surface 72 of the annular ridge 69 to the distance $d_s$ between the plane 76 and the slit 64 may be about 3 to 1. In the particular embodiment illustrated herein, the inner diameter of the inner surface may be about 1.6 inches, and the distance $d_s$ may be about 0.55 inches.

Figure 5:
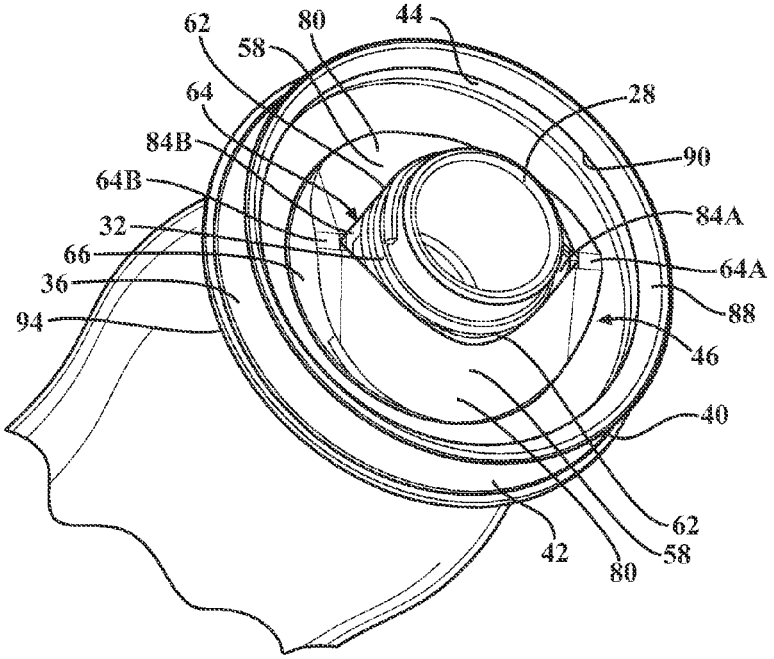
FIG. 5 is a bottom perspective view illustrating a drink bottle neck partially inserted through a valve portion of the fill cap.

FIGS. 5 and 6 illustrate the relationship of the drink bottle 16 to the fill cap 14 during a refill operation of the drink container 12, where FIG. 5 illustrates the drink bottle 16 positioned in the cup area 75 partially inserted through the slit 64 and FIG. 6 illustrates the drink bottle 16 in a fully inserted and retained position on the fill cap 14. It should be understood that the relationship of the annular ridge 69 of the fill cap 14 to the location of the slit 64 is such that the bottle neck 28 of the drink bottle 16 positioned in the fill cap 14 will extend through the slit 64 a predetermined distance. In particular, as seen in FIG. 6, the drink bottle 16 is inserted a substantially maximum distance though the slit 64, as defined by engagement of the shoulder portion 30 of the drink bottle 16 on the tapered end portion 74 of the annular ridge 69. Preferably, the taper of the end portion 74 substantially matches the taper or angle of the drink bottle's shoulder portion 30 for providing a substantially constant engagement surface around the circumference of the shoulder portion 30.

In accordance with an aspect of the invention, in the fully inserted position, the major rib portion 34 of the drink bottle 16 is positioned in engagement with the inner lip edges 62 at a lower side 80 of the lip members 58. That is, an upwardly facing side 82 of the major rib portion 34 is located at an engagement position for contact with the inner lip edges 62 at the lip member's lower side 80, which engagement position provides a substantial resistance to extraction of the drink bottle from the cup area 75 of the fill cap 14. In particular, movement of the drink bottle upwardly out of the cup area 75 will tend to bias the inner lip edges 62 toward the bottle neck 28, tending to reduce a passage area for the major rib portion 34. Further, the stiffness of the material of the fill cap 14 facilitates maintaining the lip members 58 in engagement with the bottle neck 28 with limited flexure of the lip members 58.

It should be noted that the lip members 58 are formed with a taper that facilities insertion of the bottle neck 28, and particularly the major rib portion 34, through the slit 64 while also providing a required rigidity, facilitated by the predetermined material hardness, requiring a predetermined force for removal of the bottle neck 28 from the slit 64. That is, the lip members 58 have a tapering thickness that decreases from the annular flange 46 to the inner lip edges 62. For example, the thickness of lip members 58 may taper from the annular flange 46 to the inner lip edges 62 at a ratio that may lie within a range of about 3 to 1 to about 4 to 1. The reduced thickness of the lip members 58 near the inner lip edges 62 provides an increased flexibility to permit separating or opening movement of the inner lip edges 62 during passage of the major rib portion 34 through the slit 64, both during insertion and removal, i.e., with application of a predetermined removal force.

It may also be noted that the length of the slit 64 is formed to be greater than the diameter dimension of the major rib portion 34, such that the area of the slit 64 is substantially greater than the diameter dimension of the bottle neck 28 that is positioned therethrough. For example, the length of the slit 64 may be about 1.5 inches, as compared to a diametric dimension of the major rib portion 34 of the drink bottle 16 of about 1.1 inches. The larger length dimension of the slit 64 facilitates passage of the major rib portion 34, providing a reduced stress at the unslit end portions 64*a*, 64*b*, and further provides intentionally unsealed vent passage areas 84*a*, 84*b*, i.e., triangular openings, adjacent to the unslit end portions 64*a*, 64*b*, as seen in FIG. 5. In particular, while the engagement of the lip members 58 against the bottle neck 28 and the major rib portion 34 provides sufficient contact area, and an associated retention force to retain the drink bottle 16 within the cup area 75, gaps defined by the passage areas 84*a*, 84*b* permit passage of air through the slit 64 when the drink bottle 16 is in position on the fill cap 14. Hence, as a drink fluid is transferred from the drink bottle 16 to the drink container 12, air may be readily displaced from the drink container 12 to facilitate a quick fill operation of the drink container 12 wherein the flow of fluid into the drink container 12 is substantially unhindered by the air pressure in the container 12.

The fill cap 14 is mounted to the drink container 12 with a structure that ensures that the fill cap 14 may remain substantially stationary relative to the drink container 12 during application of forces from the drink bottle 16 as the drink bottle is both inserted to and removed from the fill cap 14. Referring to FIG. 6, the drink container 12 for use with the fill cap 14 includes a radially outwardly extending rib portion 86 formed on the outer perimeter 24 of the drink container 12. Referring additionally to FIG. 4, the cylindrical collar 36 includes a rib portion 88 extending radially inwardly from the inwardly facing surface 44 of the collar 36. A groove 90 is defined between the radially inwardly extending rib portion 88 and the annular flange 46 for receiving the radially outwardly extending rib portion 86 to retain the fill cap 14 on the drink container 12. Further, the collar 36 is configured to form a resilient, tight fit around the outer perimeter 24 of the drink container 12 whereby the groove 90 of the fill cap 14 is not readily displaced from the rib portion 86 of the drink container 12. In accordance with an aspect of the invention, the diameter of the inwardly facing surface 44 is about 4 percent smaller than the diameter of the outer perimeter 24 of the drink container 12 such that the collar 36 is stretched when in position on the drink container 12. For example the drink container 12 may be formed with an outer diameter of about 2.5 inches and the inwardly facing surface 24 of the collar may define a diameter of about 2.4 inches.

In order to facilitate removal of the fill cap 14 from the drink container 12, such as may be required for cleaning of the drink container 12, a flange extension 94 is provided extending from the annular flange 46, radially outwardly from the annular collar 36. The flange extension 94 provides a grip location for a user to bias the outer edge of the fill cap 14 upwardly from the drink container 12.

It should be noted that the slit 64 may comprise a substantially closed slit 64 when the fill cap 14 is in an unstretched condition or state, i.e., prior to mounting on the drink container 12. However, when the fill cap 14 is mounted to the drink container 12, stretching the collar 36, the inner lip edges 62 are moved apart slightly to open the slit 64 a predetermined small amount, as is illustrated by the inner lip edges 62 in FIG. 2. The opening of the slit 64 in the mounted or stretched condition of the filler cap 14 on the upper end 18 of the drink container 12 is due to the structural coupling of the lip members 58 to the annular collar 36 via the annular flange 46, and provides a "pulling" force in a direction generally parallel to the plane 76 of the flange 46 for opening the slit 64. The slightly open slit 64 provides a passage for fluid to flow from the cup area 75 into the drink container 12 when a drink bottle 16 is not positioned in the cup area 75. Specifically, it may be possible for fluid to leak through a fully closed valve with a possible accumulation of fluid in the cup area 75, such as may occur during bouncing of the drink container 12 with a bicycle to which it is mounted, and which may ultimately result in the fluid splashing out onto the cyclist or the bicycle. The limited opening at the slit 64 provided for the present valve structure 56 is sufficiently small to prevent substantial outward splashing of fluid out of the cup area 75, while providing an opening passage for any fluid reaching an outer surface 92 of the lip members 58 at the cup area 75 to be retained in the cup area 75 and return readily to the fluid container 12. Further, the relatively thinner material thickness of the lip members 58 adjacent to the area of the slit 64 permits the lip members 58 to move to a closed position in response to fluid pressure applied to the lower side 80 of the lip members 58, substantially preventing passage of fluid into the cup area 75.

In a use of the hydration system 10 described herein, the drink container 12 may be mounted to location on a bicycle (not shown), such as to the bicycle frame or between aero bars of the bicycle, with the fill cap 14 positioned over the upper end 18 of the drink container 12. During a cycling event, a cyclist may grasp a drink bottle 16 while passing a water station and locate the drink bottle 16 in an inverted position within the cup area 75 of the fill cap 14, pushing the neck 28 of the drink bottle 16 through the slit 64. With the bottle neck 28 positioned such that the major rib portion 34 is located below the lip members 58, the lip members 58 may apply an axially inwardly directed biasing force on the drink bottle 16. It may be noted that the predetermined converging angle formed by the lip members 58, as described above, provides a control of a predetermined biasing force applied against the bottle neck 28 to retain the drink bottle 16 in position.

The drink bottle 16 will be maintained in a stationary substantially vertical orientation by engagement with the annular ridge 69 and the cyclist may release their grasp on the drink bottle 16. The drink bottle 16 may remain in engagement with the fill cap 14 as its contents are drained into the drink container 12. Subsequently, the cyclist may grasp the drink bottle 16 and apply a sufficient force to overcome the retention force of the lip members 58, and flex the relatively thinner end portions of the lip members 58, to withdraw the bottle neck 28 from the slit 64.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An elastomeric fill cap for a drink container for receiving an open end of a drink bottle having a bottle body with a bottle neck of reduced diameter, the bottle neck having a minor radially extending rib portion defining a thread for receiving a bottle cap and a major radially extending rib portion for engaging an end of the bottle cap located over the minor rib portion, the drink container including an open end defined by an upper end having an inner perimeter and an outer perimeter, the fill cap comprising:

a cylindrical collar defining an axis extending centrally of the fill cap, the cylindrical collar having an axial lower end and an axial upper end;

an annular flange extending perpendicular to the axis radially inwardly from the cylindrical collar, the annular flange having a radial outer edge connected to the axial upper end of the cylindrical collar and a radial inner edge;

a valve structure connected to and surrounded by the annular flange, the valve structure comprising:

a pair of planar lip members;

each lip member having an outer portion adjoining the inner edge of the flange and the lip members converging at an angle axially downwardly to inner edges where the lip members adjoin each other at a slit axially inward from the outer portions of the lip members in a closed position of the valve structure; and a pair of opposing side walls extending from the inner edge of the flange to edges of the lip members located axially downwardly from the inner edge of the flange; and the slit configured to receive the bottle neck therethrough; and wherein the cylindrical collar, annular flange and valve structure, including the lip members and opposing side walls, are formed as a unitary molded structure of an elastomeric material.

2. The elastomeric fill cap of claim 1, wherein the annular flange includes an upper surface defining a plane perpendicular to the axis defined by the cylindrical collar, and including an annular ridge, at least a portion of which is contiguous with the opposing side walls and extending upwardly above the plane of the annular flange to support a portion of the bottle body when the bottle neck is positioned through the slit.

3. The elastomeric fill cap of claim 2, wherein the slit extends a length between the opposing side walls that is greater than a diametric dimension of the major rib portion on the bottle neck.

4. The elastomeric fill cap of claim 3, wherein the slit is adapted to engage a side of the major rib portion at a location on the bottle neck opposite the minor rib portion when the bottle body is engaged on the annular ridge.

5. The elastomeric fill cap of claim 2, wherein the bottle body includes a shoulder portion tapering from the bottle neck, and the annular ridge includes an outer end located distal from the annular flange wherein the outer end is tapered radially outwardly extending in the direction away from the annular flange for engagement with the tapered shoulder portion of the bottle body.

6. The elastomeric fill cap of claim 2, wherein a ratio of an inner diameter of the annular ridge to a vertical distance measured from a plane defined by an outer end of the annular ridge to the slit is 3 to 1.

7. The elastomeric fill cap of claim 1, wherein the collar is adapted to be positioned over the open end of the upper end of the drink container.

8. The elastomeric fill cap of claim 7, wherein an inner diameter of the collar, in an unstretched condition, is smaller than a diameter of the outer perimeter of the drink container, and the lip members are coupled to the collar via the annular flange to effect a predetermined opening of the slit when the collar is positioned over the upper end of the drink container.

9. The elastomeric fill cap of claim 1, wherein the lip members are oriented relative to each other at an included angle within a range of about 130 degrees to 135 degrees.

10. The elastomeric fill cap of claim 9, wherein the lip members are oriented relative to each other at an included angle of about 133.5 degrees.

11. The elastomeric fill cap of claim 9, wherein a thickness of each of the lip members decreases in a direction from the inner edge of the annular flange to the slit.

12. The elastomeric fill cap of claim 1, including an annular rib portion extending radially inwardly from an inwardly facing surface of the cylindrical collar, the annular rib portion defining, with the annular flange, a groove for receiving a radially outwardly extending rib portion formed on the outer perimeter of the drink container for retaining the fill cap on the drink container.

13. A fill cap in combination with a drink container, the fill cap being formed of an elastomeric material and configured for receiving an open end of a drink bottle having a bottle body with a bottle neck of reduced diameter, the drink container including an open end defined by an upper end having an inner perimeter and an outer perimeter, the fill cap comprising:

a cylindrical collar defining an axis extending centrally of the fill cap, the cylindrical collar having an axial lower end and an axial upper end;

an annular flange extending perpendicular to the axis radially inwardly from the cylindrical collar, the annular flange having a radial outer edge connected to the axial upper end of the cylindrical collar and a radial inner edge;

a valve structure connected to and surrounded by the annular flange, the valve structure comprising:

a pair of planar lip members;

each lip member having an outer portion adjoining the inner edge of the flange and the lip members converging at an angle axially downwardly to inner edges where the lip members adjoin each other at a slit axially inward from the outer portions of the lip members in a closed position of the valve structure; and a pair of opposing side walls extending from the inner edge of the flange to edges of the lip members located axially downwardly from the inner edge of the flange; and wherein an inner diameter of the collar, in an unstretched condition, is smaller than a diameter of the outer perimeter of the drink container, and the lip members are coupled to the collar via the annular flange to effect a predetermined opening of the slit when the collar is positioned over the upper end of the drink container; and wherein the cylindrical collar, annular flange and valve structure, including the lip members and opposing side walls, are formed as a unitary molded structure of an elastomeric material.

14. The fill cap of claim 13, wherein the annular flange includes an upper surface defining a plane perpendicular to the axis defined by the cylindrical collar, and including an annular ridge, at least a portion of which is contiguous with the opposing side walls and extending upwardly above the plane of the annular flange to support a portion of the bottle body when the bottle neck is positioned through the slit.

15. The fill cap of claim 14, wherein the bottle body includes a shoulder portion tapering from the bottle neck, and the annular ridge includes an outer end located distal from the annular flange wherein the outer end is tapered radially outwardly extending in the direction away from the annular flange for engagement with the tapered shoulder portion of the bottle body.

16. The fill cap of claim 14, wherein a ratio of an inner diameter of the annular ridge to a vertical distance measured from a plane defined by an outer end of the annular ridge to the slit is 3 to 1.

17. A method of using a fill cap to fill a drink container from a drink bottle having a bottle body with a bottle neck of reduced diameter, the bottle neck having a minor radially extending rib portion defining a thread for receiving a bottle cap and a major radially extending rib portion for engaging an end of the bottle cap located over the minor rib portion, wherein the fill cap comprises a cylindrical collar defining an axis extending centrally of the fill cap, the cylindrical collar positioned over an open upper end of the drink container, an annular flange extending perpendicular to the axis and having a radial outer edge connected to the cylindrical collar and a radial inner edge, a valve structure connected to and surrounded by the annular flange, the valve structure comprising a pair of planar lip members, each lip member having an outer portion adjoining the inner edge of the flange and the lip members converging at an angle axially downwardly to inner edges where the lip members adjoin each other at a slit axially inward from the outer portions of the lip members in a closed position of the valve structure, and a pair of opposing side walls extending from the inner edge of the flange to edges of the lip members located axially downwardly from the inner edge of the flange to define a cup area above the lip members and at least partially surrounded by the side walls; and wherein the cylindrical collar, annular flange and valve structure, including the lip members and opposing side walls, are formed as a unitary molded structure of an elastomeric material, the method comprising:

inserting the drink bottle into the cup area with at least the portion of the bottle neck including the minor rib portion positioned extending through the slit;

providing a flow of fluid transferring the fluid from the drink bottle into the drink container; and providing a flow of air through predetermined openings formed between the lip members and the bottle neck at opposing ends of the slit when the bottle neck is positioned through the slit to effect a release of air pressure from the drink container as the fluid is transferred from the drink bottle to the drink container.

18. The method of claim 17, wherein inserting the drink bottle into the cup area further includes locating a tapered shoulder portion of the drink bottle in engagement with a ridge portion surrounding the cup area, and the lips engaging the bottle neck to effect a retention of the shoulder portion in engagement with the ridge portion.

19. The method of claim 18, wherein inserting the drink bottle into the cup area further includes inserting the major rib portion past the slit, and a lower side of the lip members engaging the major rib portion to provide a biasing force of the lip members against the major rib portion to retain the shoulder portion in engagement with the ridge portion.

* * * * *